US005709492A

United States Patent [19]

Yasunaga et al.

[11] Patent Number: 5,709,492

[45] Date of Patent: Jan. 20, 1998

[54] LIQUID APPLICATOR

[75] Inventors: Masahiro Yasunaga, Osaka; Shigeyasu Inoue, Kashiwara, both of Japan

[73] Assignee: Sakura Color Products Corp., Osaka-fu, Japan

[21] Appl. No.: 650,219

[22] Filed: May 20, 1996

Related U.S. Application Data

[63] Continuation of Ser. No. 321,765, Oct. 12, 1994, abandoned.

[30] Foreign Application Priority Data

| | | | |
|---|---|---|---|
| Apr. 27, 1994 | [JP] | Japan | 6-113703 |
| Apr. 27, 1994 | [JP] | Japan | 6-113704 |
| May 14, 1994 | [JP] | Japan | 6-124321 |

[51] Int. Cl.[6] ..... B43K 8/20

[52] U.S. Cl. ..... 401/208; 401/215; 401/216; 401/220

[58] Field of Search ..... 401/208, 216, 401/220, 215

[56] References Cited

U.S. PATENT DOCUMENTS

| | | | |
|---|---|---|---|
| 3,284,839 | 11/1966 | Cook | 401/208 X |
| 3,781,123 | 12/1973 | Linz et al. | 401/216 |
| 4,129,391 | 12/1978 | Gamacher . | |
| 4,842,433 | 6/1989 | Otsuka | 401/216 X |
| 4,940,350 | 7/1990 | Kim | 401/215 X |
| 5,213,431 | 5/1993 | Gentile et al. | 401/208 X |

FOREIGN PATENT DOCUMENTS

| | | | |
|---|---|---|---|
| 962771 | 12/1949 | France | 401/208 |
| 1007270 | 2/1952 | France | 401/208 |
| 1557051 | 2/1969 | France . | |
| 2160697 | 6/1973 | France . | |
| 830100 | 1/1952 | Germany | 401/208 |
| 2115043 | 10/1972 | Germany | 401/216 |
| 2709852 | 9/1978 | Germany . | |
| 3121948 | 12/1982 | Germany | 401/208 |
| 8520507 | 8/1985 | Germany . | |
| 164674 | 7/1986 | Japan | 401/208 |
| 8702183 | 4/1989 | Netherlands | 401/208 |
| 232387 | 5/1944 | Switzerland . | |
| 643626 | 9/1950 | United Kingdom . | |

*Primary Examiner*—Steven A. Bratlie

*Attorney, Agent, or Firm*—Wood, Phillips, VanSanten, Clark & Mortimer

[57] ABSTRACT

A liquid applicator using a roller which is effectively prevented from being disengaged from the housing thereof. The liquid applicator provides very smooth flow of ink from the initial touch of drawing without generating a scratchy effect. The improved liquid applicator introduces a roller in place of a conventional ball of a ball pen. The roller is a hollow structure. A roller-storing portion is defined by a surface having stepped tapered portions. The liquid applicator incorporates a relay core. The relay core comes into contact with the roller in the roller-storing portion to press the roller in the direction of an aperture on the roller-storing portion.

18 Claims, 11 Drawing Sheets

LIQUID APPLICATOR

This application is a continuation of application Ser. No. 08/321,755, filed Oct. 12, 1994 now abandoned.

BACKGROUND OF THE INVENTION

1. Field of the Invention

The present invention relates to a liquid applicator for writing letters or painting other surfaces and, more particularly, to a liquid applicator capable of transferring ink onto a surface by rotation of a roller.

2. Description of the Related Art

Today, ball pens have widely been popularized as convenient liquid applicators. However, since the writing (or painting) member for transferring ink onto a surface literally comprises a ball coming into contact with the surface at a point, these conventional ball pens are not suited for drawing thick lines or painting a broad surface.

Japanese Laid-Open Utility Model Publication No. SH058-69479 (1988) proposes a liquid applicator for drawing broad lines with a roller introduced in place of a ball.

In response, referring to the above Japanese Laid-Open Utility Model Publication No. SH058-69479, inventors of the present invention experimentally fabricated a liquid applicator by replacing a ball of an oil ball pen (loaded with oil ink) with a roller.

Although the above Japanese Utility Model Publication No. SH058-69479 does not concretely specify numerical value of roller diameter, since the ball of any conventional oily ball pen has about 0.6 mm of diameter, the experimentally fabricated liquid applicator was also provided with 0.6 mm of roller diameter.

Nevertheless, the roller of the experimentally fabricated liquid applicator could not properly rotate itself, thus failing to function as a liquid applicator.

The inventors again experimentally fabricated such a liquid applicator incorporating a roller having more than 6 mm of diameter. In contrast with the initially fabricated liquid applicator incorporating a roller having 0.6 mm of diameter, the roller of the newly fabricated liquid applicator smoothly rotated.

However, even the liquid applicator newly fabricated proved to be still defective in the following two respects.

The first problem was that the experimentally fabricated liquid applicator could not withstand shock. On receipt of shock from a drop test, the roller built in the newly fabricated liquid applicator dropped off from the roller holding portion.

Although the inventors tried to prevent the roller from dropping off from the roller portion by applying a variety of techniques normally being performed in the ball pen industry, such as a new way of caulking the tip of the roller retaining portion and adjustment of the aperture of the roller retaining portion, neither of the applied techniques turned out to be acceptable for use.

The secondary problem was that ink could not smoothly flow out of the roller as in writing letters. Probably, this symptom was caused by the following two reasons.

After finishing the writing with any conventional liquid applicator, when the liquid applicator is oriented with the roller on top, the roller falls under its weight onto the part of the holder.

When expanding the roller diameter, in order to expose the circumferential surface of the roller, the aperture of the roller must necessarily be expanded. Because of this, when the roller falls in the holder, clearance is generated between the roller and the holder. While laying the liquid applicator in this condition, ink in the holder is exposed to air to be dried atmospherically. As a consequence, when starting up writing, the liquid applicator is scratchy without making smooth flow of ink.

The above symptom was more significantly noticeable when the liquid applicator used aqueous ink in place of oily ink.

The other reason for causing the liquid applicator to become scratchy without smooth flow of ink at the start of writing was that ink stored in the holder was transferred to the ink-pool. The reason is described below.

In any conventional ball pen using oily ink, oily ink is always pooled in clearance formed by a ball and the ball-retaining portion. When writing letters, relative to rotation of the ball, oily ink is transferred onto a paper surface, and yet, since such a conventional ball pen incorporates a ball having a very narrow diameter, there is negligible clearance between the ball and the ball retaining portion.

When holding a ball pen such that the ball is on the top thereof, oily ink in the above clearance receives a force in the direction of the ink pool by specific gravity. Since any conventional ball pen using oil ink has narrow clearance, as mentioned above, and yet, because of high viscosity of oil ink, oily ink is prevented from being dropped off in the direction of the ink pool by virtue of adhesion between the ball and side wall or by the effect of capillary-tube force.

However, as was done by inventors, as a result of provision of a substantial diameter for the roller of the experimentally fabricated liquid applicator, clearance between the side walls and the roller is expanded, and thus, specific gravity of ink overcomes adhesion between the roller and side walls or capillary-robe force to cause ink to drop onto the ink pool.

As was previously proven, this symptom was quite evident when storing aqueous ink in the ink pool.

SUMMARY OF THE INVENTION

It is an object of the invention to develop and provide an improved liquid applicator featuring improved shock resistant properties and smooth flow of ink without incurring a scratchy effect at the start of writing letters or figures.

The improved liquid applicator according to the invention incorporates a roller having a hollow or porous structure. Because of this, the roller is of light weight and generates minimal inertia force even when receiving external shock and thus, the roller built in the inventive liquid applicator is not disengageable from the holder even when being subjected to external shock.

Since the roller of the inventive liquid applicator has light weight, the roller does not tend to fall forcibly into a roller-storing portion so that little, unwanted clearance is generated between the aperture of the roller-storing portion and the roller. Furthermore, the improved liquid applicator according to the invention is so structured that the roller is pressed in the direction of the aperture of the roller-storing portion by a relay core to further reduce this unwanted clearance between the aperture of the roller-storing portion and the roller. In consequence, the roller-storing portion of the liquid applicator according to the invention remains in a tightly closed condition to prevent the interior from being atmospherically dried.

According to the liquid applicator embodied by the invention, the surface of the roller-storing portion on the part of an ink passage hole is defined by a tapered surface having at least two portions having a flat or curved cross-sectional form conforming to the periphery of the roller, there is minimal clearance between the roller and the roller-storing portion. Owing to this structural arrangement, ink is stably held between the roller and the roller-storing portion without flowing into the ink pool at all.

The above and further objects and features of the invention will more fully be understood from the following detailed description given in reference to the accompanying drawings which are shown below solely by way of exemplification.

DESCRIPTION OF THE PREFERRED EMBODIMENTS

Figure 1:
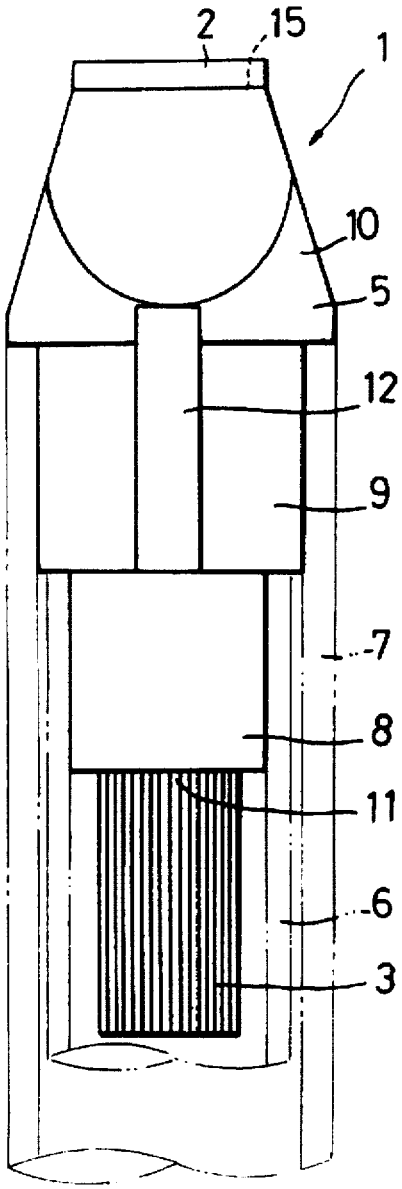
FIG. 1 is a front view of a holder with a roller-storing portion on an improved liquid applicator according to one embodiment of the invention.
Figure 2:
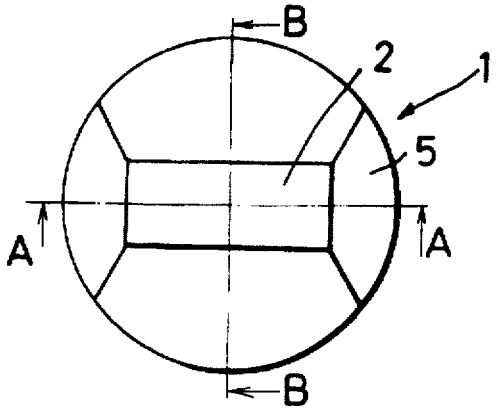
FIG. 2 is a plan of the holder on the liquid applicator shown in FIG. 1.
Figure 3:
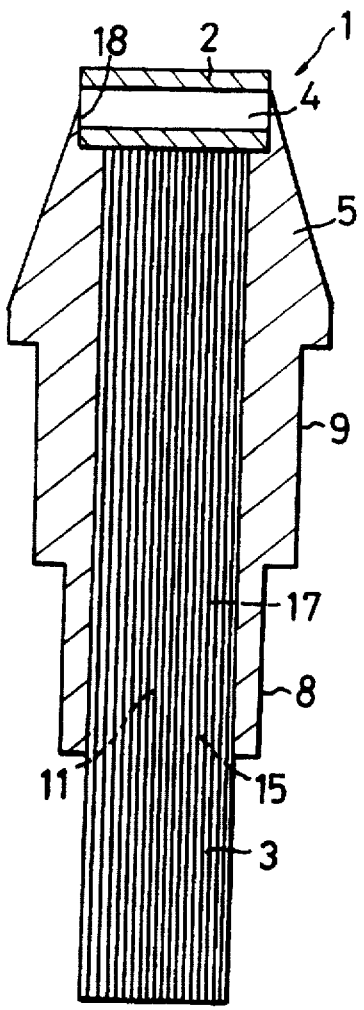
FIG. 3 is a cross-sectional view of the holder taken along line A—A in FIG. 2.

The reference numeral 1 shown in FIGS. 1 through 9 designates an improved liquid applicator according to one form of the invention. Basically, the liquid applicator 1 according to the invention comprises a holder unit 5 which is provided with a roller 2 and a relay core 3, an ink pool 6, and a pen shaft 7. The holder 5 is secured to the tip of the ink pool 6. The pen shaft 7 is secured to the outside of the ink pool 6.

The ink pool 6 and the pen shaft 7 are identical to those which are used for any conventional ball pen, where the ink pool 6 and the pen shaft 7 are made from synthetic resin and cylindrically formed.

The ink pool 6 stores an internal supply of water-soluble ink available for any conventional ball pen. More particularly, the ink pool 6 contains gelled water-soluble ink available for any conventional ball pen such as the one containing a maximum of 8000 CPS of viscosity. Both of the gelled water-soluble ink or water-soluble ink use water as the main solvent. Conventional oily ink uses organic solvent such as phenyl cellosolve or benzyl alcohol for example.

On the other hand, ink available for an aqueous ball pen uses water solvent.

Ink available for an oil ball pen contains 1000 through 3000 CPS of high-grade viscosity, whereas ink of an aqueous ball pen contains viscosity lower than the of oily ink. Ink available for an aqueous ball pen is roughly classified into two groups according to the difference in the performance of viscosity. The one is such an ink capable of performing "Newton" fluxion (viscosity remains constant according to the degree of fluxion). Viscosity in the ink pool and the ball housing is identical. Normally, ink containing through 2000 CPS of viscosity is used.

The other group of ink contains viscosity having properties that vary according to fluxion of ink. Ink belonging to the latter group contains 2000 through 8000 CPS of viscosity in the ink pool. However, when the ink is bled inside of the ball housing, viscosity is sharply reduced to a maximum of 10 CPS. Conventionally, the latter ink is called "thixotropic ink". Such a water-soluble ink added with gelling agent containing thixotropic property is generally cared "water-soluble gelled ink".

The liquid applicator 1 according to an embodiment of the invention incorporates a hollow roller 2 having a through-hole 4 in the center. The invention uses a hollow roller 2 to reduce its weight. More particularly, the light-weight roller 2 prevents unwanted clearance from being generated between a tip aperture 15 of a roller-storing portion 18 and the roller 2 itself otherwise caused by falling of the roller 2 into the roller-storing portion 18 when the roller 2 is oriented with the roller 2 on top.

Another important effect is to prevent the roller 2 from dropping off from the holder housing when the liquid applicator receives shock.

The invention permits use of copper, nickel, zinc alloy, or copper alloy such as brass, stainless steel, or resin free of metamorphosis caused by ink, to define the roller 2.

The through-hole 4 in the center of the roller 2 is generally formed by a cutting process. The ratio between the inner and outer diameters of the roller 2 approximately ranges from 0.5:1 to 0.8:1. A practical ratio is selected mainly according to rigidity of the roller 2. It is desired that the roller 2 be provided with the through-hole 4 having as wide a diameter as possible. Expansion of the size of the through hole unavoidably causes mass of the roller to decrease. Based on this reason, the wider the diameter of the through-hole 4 of the roller 2, the less the inertia force generated in the roller when incurring shock thereto, and thus the roller 2 is less likely to be disengaged from the liquid applicator.

For reference, ratio relationships between the inner and outer diameters and the weight of the roller 2 is shown in the following table.

| Ratio of inner/outer diameters | Ratio of weight |
|---|---|
| 0.5:1 | 0.75 |
| 0.7:1 | 0.51 |
| 0.75:1 | 0.44 |
| 0.8:1 | 0.36 |

Note: The table represents weight ratio when actual weight of a solid roller is 1.

The relay core 3 consists of a bundle of polyacrylic or nylon fibers. The invention also permits use of a bundle of tubular resinous filaments, or a solid polyacetal-resin or nylon-resin each having a free through-hole in the axial direction, for defining the relay core 3. Structurally, the relay core 3 is of circular/cylindrical form, where only the tip portion is flatly chipped off.

The holder 5 holds the roller 2 and the relay core 3, which is formed by injection molding of polypropylene resin, or the like. The external configuration of the holder 5 is sectioned into 3 parts including an ink supply unit 8, a pen shaft insert 9, and an exposed portion 10. The ink supply unit 8 has circular section whose external circumference is substantially equal to the inner diameter of the ink pool 6. An ink inlet hole 11 is formed through the bottom of the ink supply unit 8.

Although the pen-shaft insert 9 is also of circular section, the diameter is slightly wider than that of the of the ink supply unit 8. The outer diameter of the pen-shaft insert 9 is almost equal to the inner diameter of the pen shaft 7. A pair of grooves 12 are formed in the pen-shaft insert 9 in the axial direction thereof. The grooves 12 jointly function to equalize atmospheric pressure inside and outside of the pen-shaft insert 9 so that ink from the ink supply unit 8 can smoothly flow into the holder 5.

The exposed portion 10 of the holder 5 has a circular section across the border of the pen-shaft insert 9. Structurally, the exposed portion 10 is tapered, where the tip portion is of ridge-like form. Particularly, the tip of the exposed portion 10 extends in the vertical direction against the center axis, where the tip surface has very narrow width. In addition, a rectangularly-shaped aperture 15 is formed at the tip of the exposed portion 10. The width of the tip-aperture 15 is slightly narrower than the diameter of the roller 2.

As shown in FIGS. 3 through 9, the ink inlet hole 11 and the tip aperture 15 of the holder 5 are interlinked with each other via an ink passage hole 17 and a roller-storing portion 18. The ink passage hole 17 is cylindrically formed on the part of the ink inlet hole 11. The portion of the ink passage hole 17 close to the roller-storing portion 18 is gradually flattened (in other words, the interior of the holder 5 is gradually thickened), whereas the tip of the ink passage hole 17 opens to the roller-storing portion 18.

Figure 4:
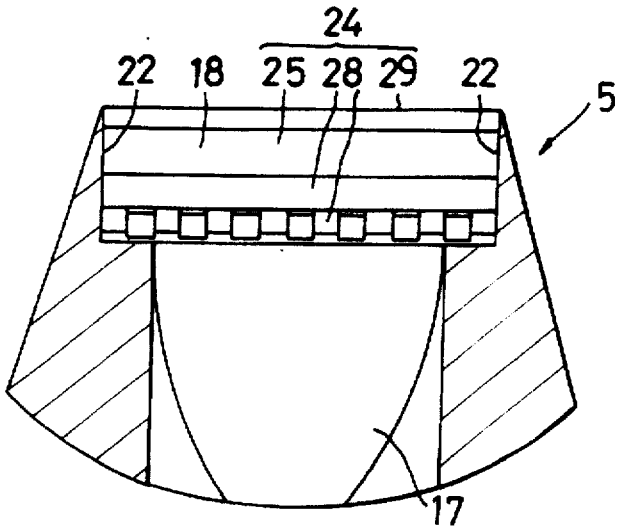
FIG. 4 is an enlarged sectional view of the main components of the roller-storing portion of the holder with no roller therein.
Figure 5:
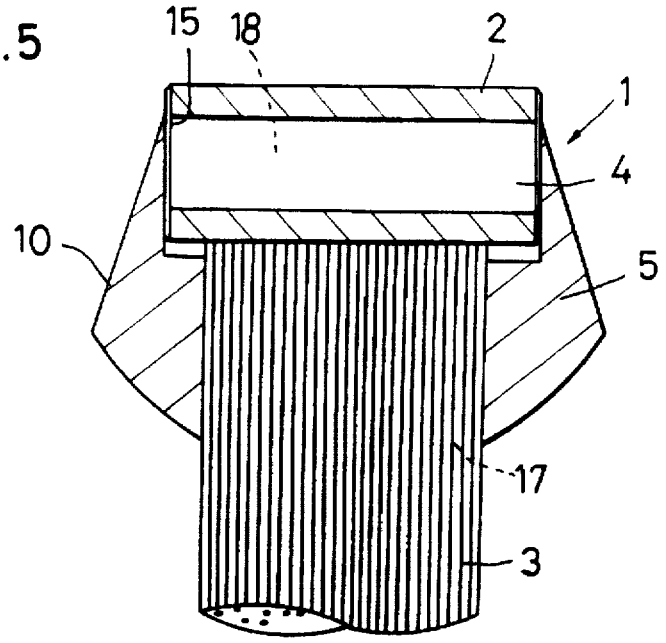
FIG. 5 is an enlarged view of the main components of the holder shown in FIG. 3.
Figure 6:
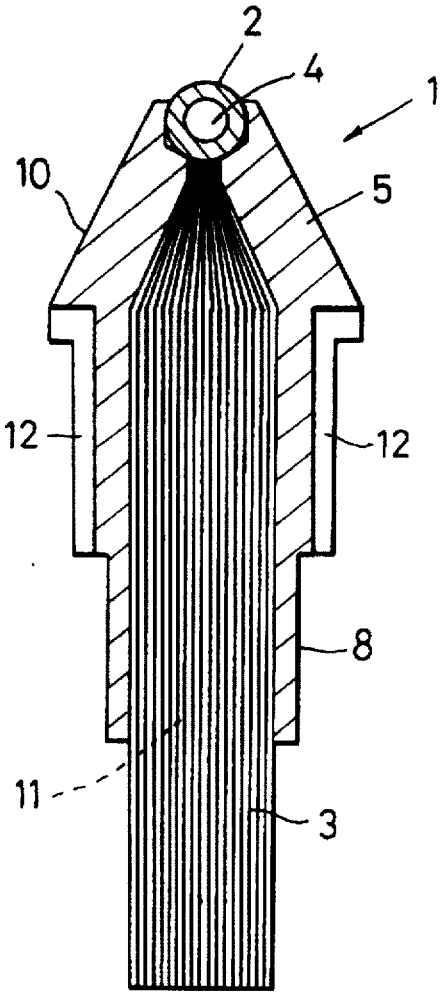
FIG. 6 is a cross-sectional view of the holder taken along line B—B in FIG. 2.
Figure 7:
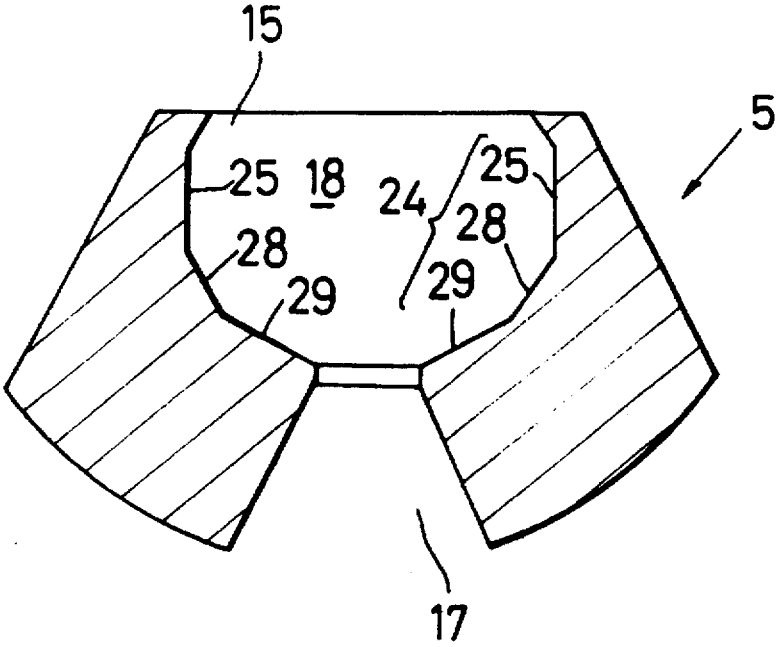
FIG. 7 is an enlarged sectional view of the main components of the roller-storing portion of the holder with no roller therein.

The roller-storing portion 18 rotatably accommodates the roller 2 therein. As shown in FIGS. 4 and 7, the roller-storing portion 18 has a polygonal section surrounded by vertically flat edge surfaces 22 and a circumferential surface 24. The inner dimension of the edge surfaces 22 is greater than the total length of the roller 2 by approximately one 100th millimeter. Accordingly, even when the roller 2 is mounted, both edge surfaces 22 do not press the corresponding edge surfaces of the roller 2.

The circumferential surface 24 is composed of four continuous surfaces. The circumferential surface 24 has a pair of surfaces 25 being in parallel with an axial line and a pair of double-step flat (or curved) tapered surfaces 28 and 29 being continuous to the axially parallel surfaces 25. The tapered surface 28 continuous to the axially parallel surfaces 25 defines an acute angle in cross section, whereas the other tapered surface 29 continuous to the tapered surface 28 defines an obtuse angle in cross section. The tapered surfaces 28 and 29 respectively converge themselves in the direction of the border between the roller-storing portion 18 and the ink inlet hole 17. A number of shallow grooves are formed on the tapered surface 29.

The roller 2 is pressed into the roller-storing portion 18 via the tip aperture 15 of the holder 5. On the other hand, the relay core 3 is pressed from the ink inlet hole 11 of the holder 5, where the tip of the relay core 3 projects into the roller-storing portion 18.

Figure 8:
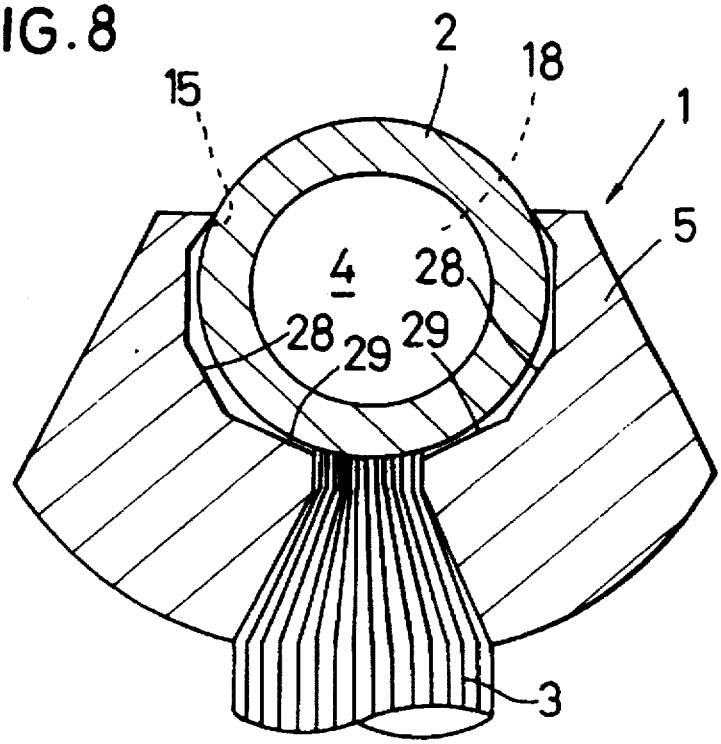
FIG. 8 is an enlarged view of the main components of the holder shown in FIG. 6.
Figure 9:
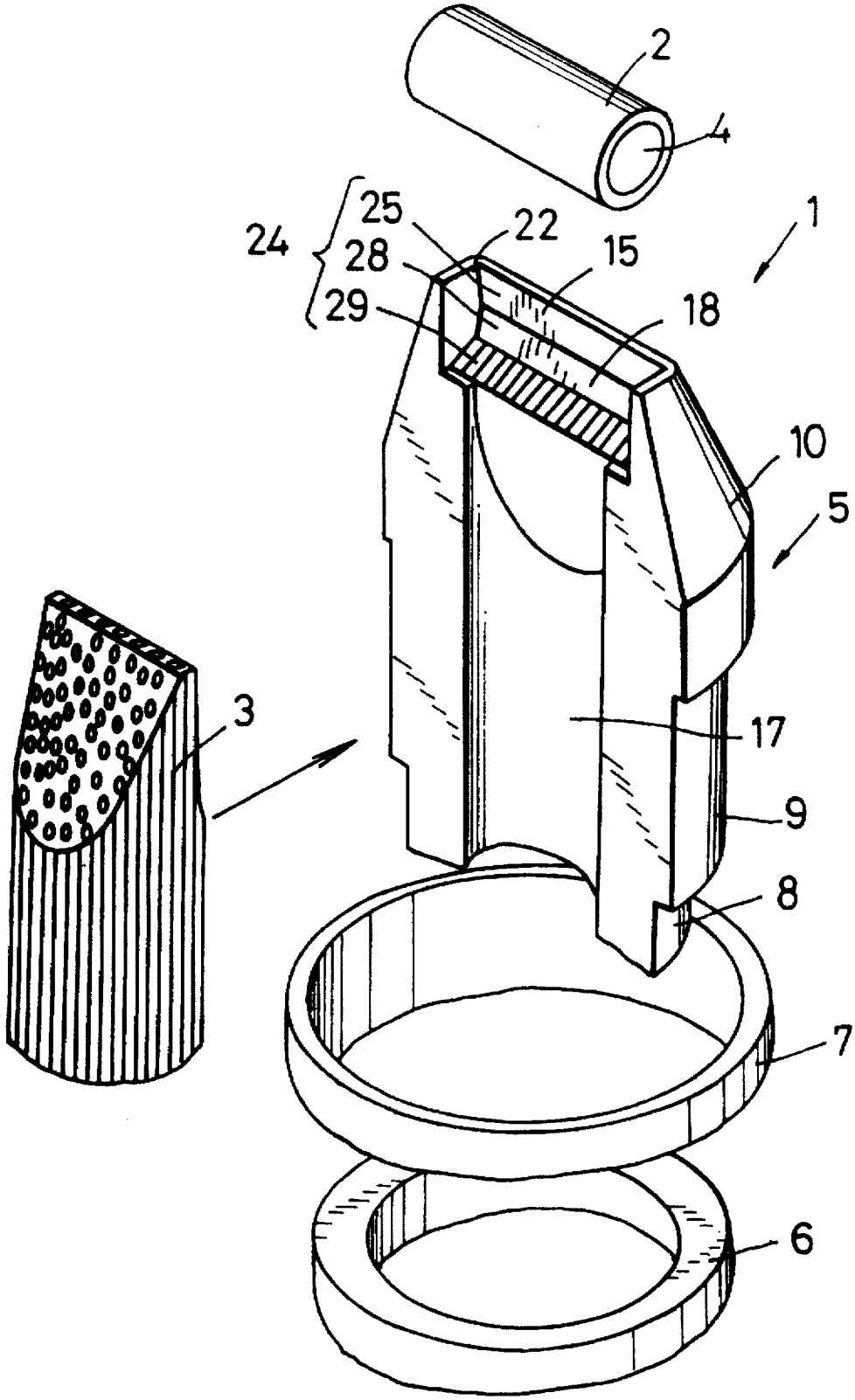
FIG. 9 is a perspective view of disassembled components of the liquid applicator shown in FIG. 1 with a partial sectional view of one of them.

When the roller 2 and the relay core 3 are respectively secured to the holder 5, as shown in FIG. 8, the lip of the relay core 3 constantly remains in contact with circumferential surface of the roller 2 so that the roller 2 is pressed in the direction of the tip aperture 15. As a consequence, the circumferential surface 24 of the roller 2 closely seals to the longitudinal portions of the edge of the tip aperture 15, and thus no clearance is formed in the aperture 15. In other words, while the inventive liquid applicator is out of use, the roller storing portion 18 is fully shielded from external atmosphere, thus maintaining air-tightness.

Although there is negligible clearance between the edge surface of the roller 2 and the edge surfaces 22 of the roller storing portion 18, since there is substantial contact area between both edge surfaces, external atmosphere can hardly permeate therethrough. The roller 2 itself is in such a state as though being afloat by way of leaving the bottom surface of the roller-storing portion 18 (the surface on the part of the ink inlet hole 17) after being pressed by the relay core 3.

When drawing a line with the liquid applicator 1 embodied by the invention, the exposed portion of the roller 2 is pressed against a paper surface by downwardly holding the roller 2. When the roller 2 is held downward, ink flows into the holder 5 via the relay core 3, and then the roller-storing portion 18 is filled with ink. When this condition occurs, minimal clearance is generated between the roller 2 and the tip aperture 15.

When shifting the liquid applicator 1 while the above condition is underway, the roller 2 rolls itself over the paper surface to permit outgoing ink to be transferred onto the paper surface.

According to the liquid applicator 1 embodied by the invention, even when the liquid applicator 1 is vertically oriented, as in a pen stand after completing a drawing work by putting the roller 2 atop, ink can be prevented from flowing into the ink pool 6.

According to the inventive liquid applicator 1, since double-step, tapered surfaces 28 and 29 are formed on the part of the ink inlet hole of the roller-storing portion 18, there is minimal clearance between the roller 2 and the roller-storing portion 18 in the semi-spherical area at the ink inlet hole. In other words, the longest distance between the roller 2 and the circumferential surface 24 is by far shorter than that of conventional liquid applicators.

In terms of concrete numerical values, assuming that there is 2 mm of diameter of the roller 2, if a single-step tapered surface were provided, then there is a maximum of 0.16 mm of clearance between the roller 2 and the roller-storing portion 18. On the other hand, according to the structure embodied by the invention, there is merely 0.04 mm of clearance between the roller 2 and the roller-storing portion 18. Owing to this structure, ink is retained by adhesion between the roller 2 and the roller-storing portion 18 or by capillary robe force, and thus, ink is prevented from flowing into the ink pool 6.

After completing a drawing work, the roller 2 is pressed in the direction of the tip aperture 15 by the relay core 3 to fully close the tip aperture 15. This in turn securely prevents air from the tip aperture 15 from permeating into the roller-storing portion 18 and also prevents air from being replaced inside of the roller-storing portion 18, thus eventually preventing ink from flowing into the ink pool 6 otherwise caused by the effect of atmospheric pressure. Furthermore, since the tip aperture 15 is fully closed by the roller 2, ink inside of the roller-storing portion 18 cannot be dried. In consequence, whenever resuming the drawing with the inventive liquid applicator 1, ink flows out very smoothly from the initial touch against a paper surface.

Furthermore, with the inventive liquid applicator 1, since the relay core 3 is disposed inside of the ink passage hole 17, the ink passage hole 17 remains closed by the relay core 3, functioning as a lid, and thus ink pooled in the roller 2 and the roller-storing portion 18 cannot flow downwardly into the ink pool 6.

On the other hand, particular caution should be exercised when selecting such a relay core 3 containing strong capillary tube force in that the relay core 3 of this kind absorbs ink from the roller-storing portion 18 without properly functioning as a lid inside of the ink passage hole 17. Nevertheless, even when using such a relay core 3 exerting excessive capillary tube force, as is done for the inventive liquid applicator 1 by way of minimizing clearance between the roller 2 and the roller-storing portion 18 based on formation of double-step tapered surfaces 28 and 29 of the roller-storing portion 18, capillary tube forces between the roller 2 and the roller-storing portion 18 overcome that of the relay core 3, thus preventing ink from flowing downward into the ink pool 6.

In particular, the liquid applicator 1 according to the invention strongly supports the roller 2 without causing the roller 2 to jump out of the holder 5 even when receiving a strong shock.

When the inventive liquid applicator 1 falls onto the ground for example, inertia force is generated in the roller 2, and then the inertia force is exerted in the direction to cause the roller 2 to drop off from the holder 5.

Nevertheless, since the roller 2 of the liquid applicator 1 related to the invention is hollow, it contains minimal mass, and thus, the roller 2 merely generates a negligible inertial force. In consequence, even when receiving substantial shock, the roller 2 remains unaffected without being separated from the holder 5.

In order to check and confirm the practical effect of the inventive liquid applicator 1, the inventors experimentally fabricated a liquid applicator 1 by internally providing a roller made of stainless steel having 4 mm of length, 2 mm of diameter, and an inner diameter that was 75% of the outer diameter. For comparative example, the inventors also experimentally fabricated a liquid applicator incorporating a solid roller having a length and external configuration exactly identical to the inventive hollow roller. As a result of a test done by dropping down both samples from a 1 meter high position, the comparative solid roller was disengaged from the liquid applicator prepared for the comparative test, whereas the hollow roller 2 of the inventive liquid applicator 1 remained unaffected and remained in a firmly secured condition.

According to the above embodiment, the roller 2 is secured to the holder 5 by arranging the tip aperture 15 of the roller storing portion 18 to be narrower than the width of the roller 2, and also by causing the circumferential surface of the roller 2 to come into contact with the back surface of the tip aperture 15 of the roller-storing portion 18.

Figure 11:
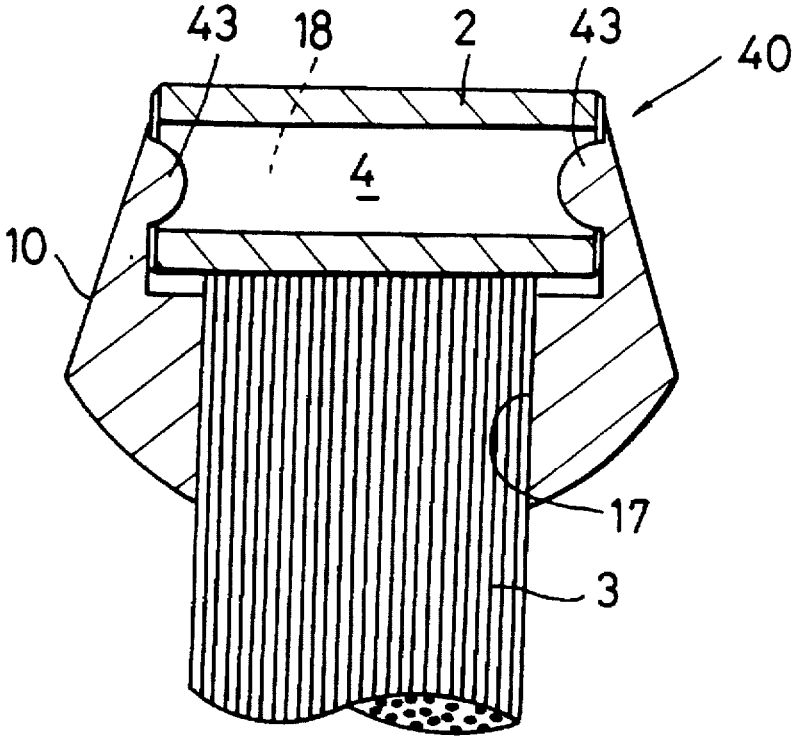
FIG. 11 is an enlarged sectional view of the main components of a further modified form of liquid applicator according to the invention.
Figure 12:
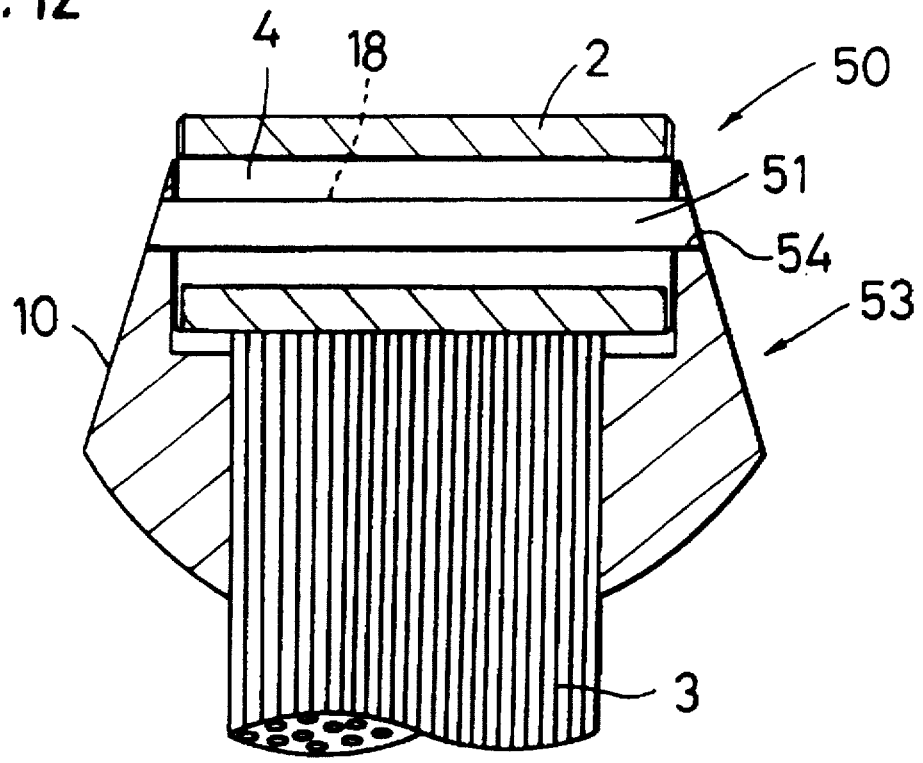
FIG. 12 is an enlarged view of the main components of another form of liquid applicator according to the invention.

When using a hollow roller 2 internally provided with a through-hole 4, instead of contracting the tip aperture 15, or in addition to the above-referenced method, it is also possible according to the invention to prevent the roller 2 from being disengaged from the holder 5 by way of utilizing the through-hole 4. Referring now to FIGS. 11 and 12, an inventive structure for preventing the roller 2 from disengaging from the holder 5 based on utilization of the through hole 4 is described below. In the following description, those component members identical to the preceding embodiment are respectively designated by the identical reference numerals, and thus, detailed description of the duplicated component members is deleted.

According to the improved liquid applicator 40 shown in FIG. 11, a pair of semispherical projections 43 are provided on both sides of the interior of the roller-storing portion 18 at positions at which the edge surfaces of the roller 2 respectively come into contact therewith. When the roller 2 is inserted under pressure, the above projections 43 respectively transform themselves, and then, when the roller 2 is set to the correct position, the projections 43 are respectively inserted in the through-hole 4.

According to the liquid applicator 40 based on the latter embodiment of the invention, even when receiving substantial shock, since the through-hole 4 of the roller 2 is securely coupled with the projections 43, the roller 2 is prevented from being disengaged from the liquid applicator 40.

It should be understood however that when engaging those projections 43 with the roller 2, as is done for the above embodiment, it is not always necessary for the invention to provide the roller 2 with a through-hole, but such a roller generally being hollow and having a partition in the intermediate portion may also be used in the same manner, according to the invention. In addition, it is also possible to use a hollow roller provided with sizable recesses on both sides.

The liquid applicator 50 shown in FIGS. 12 prevents the roller 2 from being disengaged from the holder 53 by applying a shaft 51 in place of the above-referenced projections 43.

The roller-storing portion 18 of the holder 53 introduced to this embodiment is provided with a through-hole 54. The roller 2 is disposed inside of the roller-storing portion 18. A shaft 51 extends between the through-hole 4 of the roller 2 and the roller storing portion 18. The shaft 51 extends between the through-hole 4 of the roller 2 and the roller-storing portion 18. The shaft 51 is disposed solely for the purpose of preventing the roller 2 from being disengaged from the holder 53, and conversely, provision of the shaft 51 is not based on such an intent to have it serve as a shaft for rotating the roller 2. Accordingly, the diameter of the shaft 51 is obviously narrower than that of the through-hole 4 of the roller 2.

Figure 13:
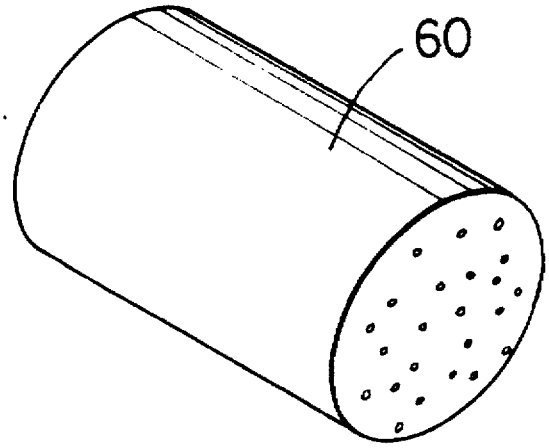
FIG. 13 is a perspective view of a roller used for another form of the invention.
Figure 14:
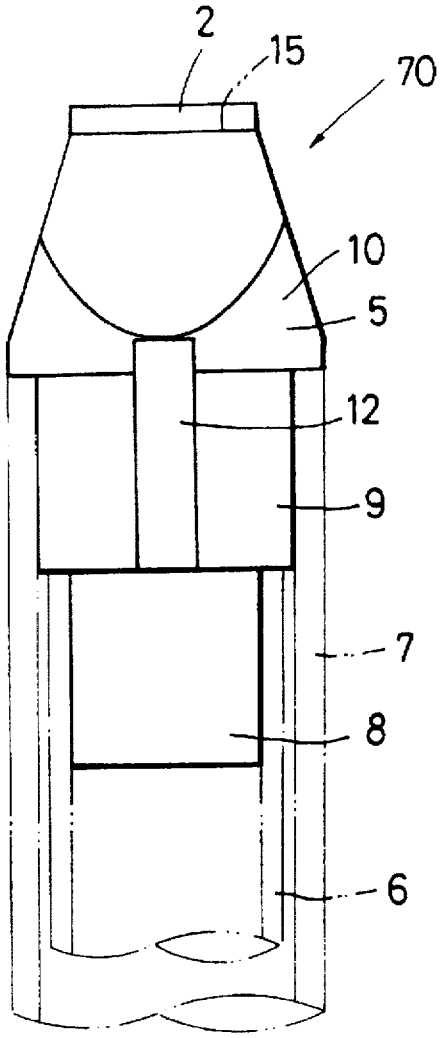
FIG. 14 is a front view of another form of holder on a liquid applicator according to the invention.
Figure 15:
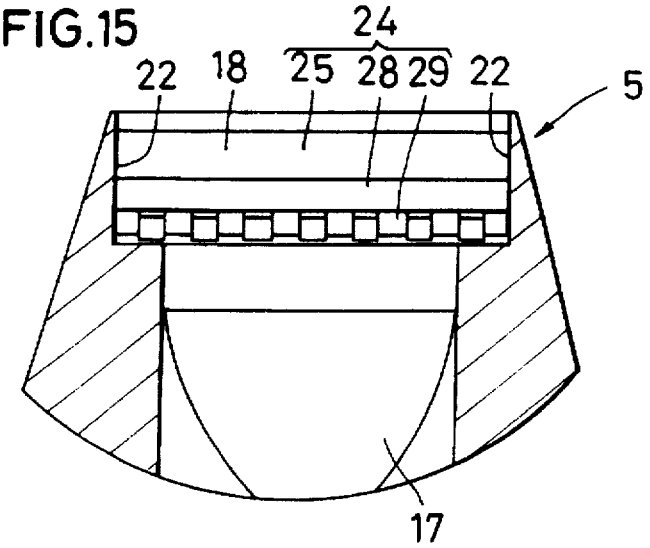
FIG. 15 is an enlarged sectional view of the main components of the roller-storing portion of the liquid applicator shown in FIG. 14 with no roller therein.
Figure 16:
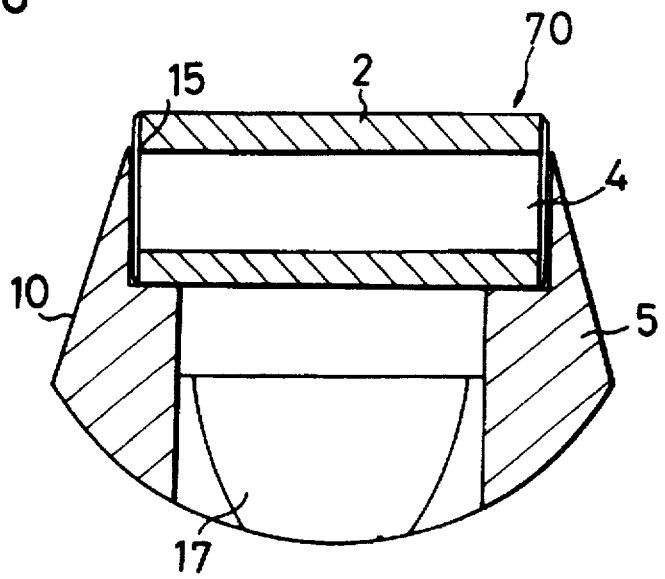
FIG. 16 is an enlarged view of the main components of the liquid applicator shown in FIG. 14.
Figure 17:
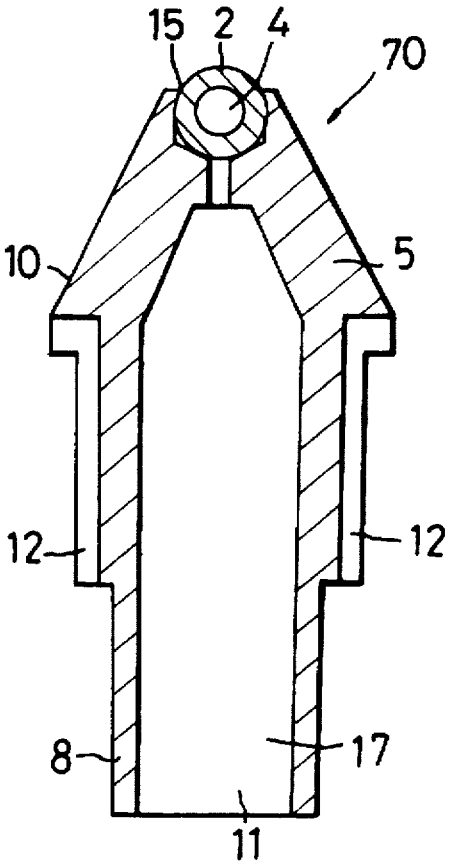
FIG. 17 is a lateral sectional view of the liquid applicator shown in FIG. 14.
Figure 18:
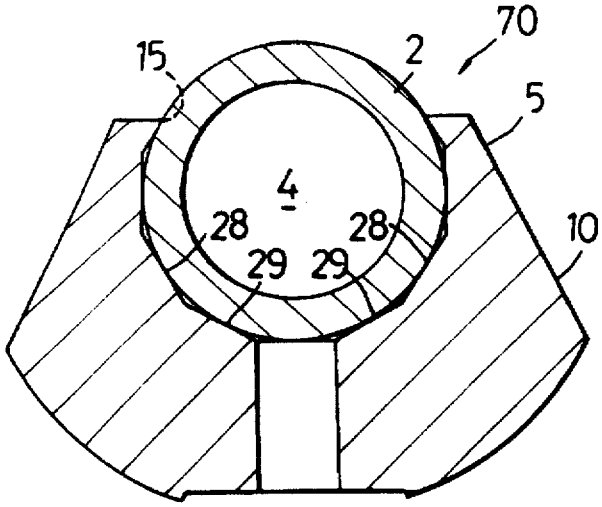
FIG. 18 is an enlarged view of the main components of the liquid applicator shown in FIG. 17.

The foregoing embodiments have respectively disclosed the cylindrical roller 2 used for the inventive liquid applicator 1. However, in order to perform an identical function, it is possible, according to the invention, to introduce a porous roller 60 shown in FIG. 13. Since the porous roller 60 contains mass that is less than that of a solid roller, like the preceding embodiments, the porous roller 60 merely generates minimal inertia force from shock, and yet, even when receiving shock, the porous roller 60 is rarely disengaged from the liquid applicator 1.

Fine holes of the porous roller 60 may contain continuous foam or independent foam, and yet, the roller 60 may be provided with a smooth surface or projections and recesses. When the roller 60 has a smooth surface, the seat surface of the roller-storing portion 18 smoothly slips in conjunction with the roller 2 while writing letters with the inventive liquid applicator 1, thus permitting the roller 2 to smoothly rotate itself. On the other hand, when there are projections and recesses on the surface of the roller 60, ink spreads over the roller 2.

Although not being illustrated in FIGS. 11 and 12, in the case of the liquid applicator 40 shown in FIG. 11 and the liquid applicator 50 shown in FIG. 12, like the preceding embodiments, the roller-storing portion is provided with double-step, tapered surfaces. The roller 2 is pressed by the relay core 3, so that the tip aperture remains fully closed.

Figure 10:
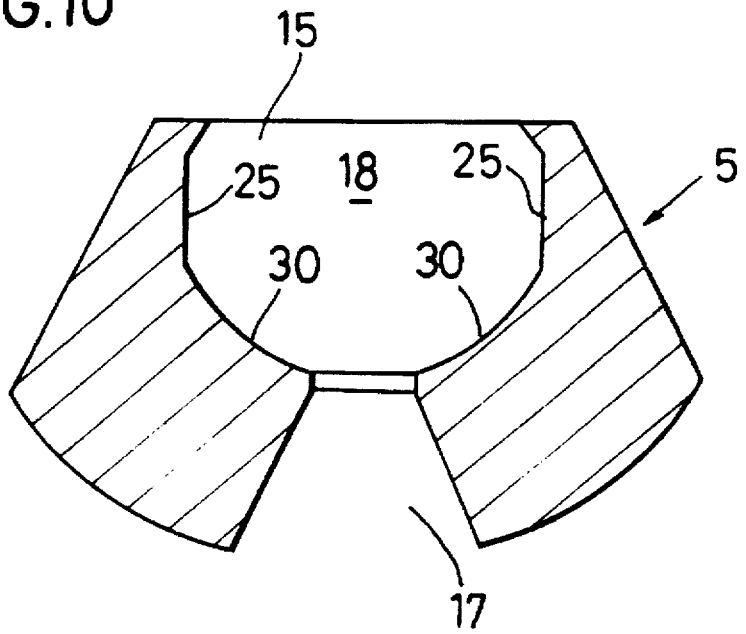
FIG. 10 is an enlarged sectional view of the main components of the roller-storing portion of a modified holder, according to the invention, without a roller.

The above embodiments have respectively exemplified double-step tapered surfaces of the roller-storing portion. It should be understood that identical effect can also be achieved by provision of triple or more than triple steps of tapered surface portions therefor. As shown in FIG. 10, instead of forming tapered surfaces, such a structure having a circular-arc surfaces 30 may also be introduced.

The above embodiments have respectively disclosed an improved liquid applicator incorporating a relay core 3 for properly guiding stored ink as the more desirable exemplification. It should be understood however, that the inventive art to minimize weight of a roller 2 by providing a hollow or porous roller 2 and to form double or more than double-step surfaces or circular-arc surfaces of the roller-storing portion, can also be applied to such a liquid applicator devoid of the relay core 3.

FIGS. 14 through 21 respectively exemplify further embodiments of the invention by applying the above novel art to a liquid applicator devoid of the relay core 3.

Those component members in the additional embodiments being identical to those of the preceding embodiments are respectively designated by identical reference numerals.

The liquid applicator 70 shown in FIGS. 14 through 19 differs from the liquid applicator 1 shown in FIGS. 1 through 9 in that no relay core is built in the liquid applicator 70. Another difference from the liquid applicator 1 is that the liquid applicator 70 is provided with parallel grooves at the border between the roller-storing portion 18 and the ink passage hole 17.

Except for the above difference, other structural details are exactly identical to those of the preceding embodiments. As was done for the preceding embodiments, double-step tapered surfaces 28 and 29 are provided for the roller storing portion 18. The roller 2 is of hollow structure.

Figure 20:
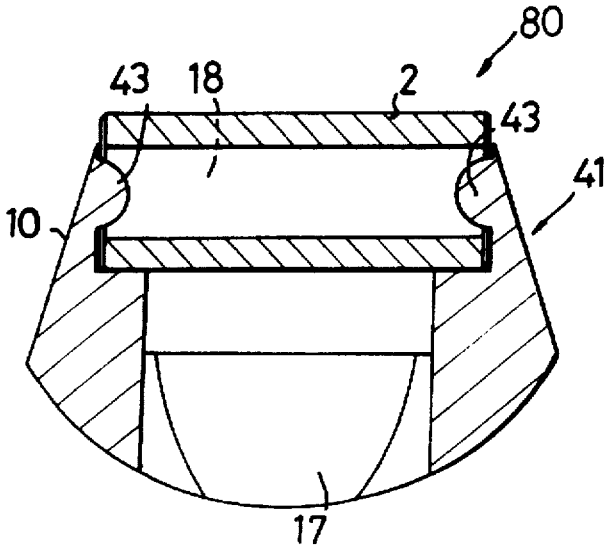
FIG. 20 is an enlarged view of the main components of another form of the liquid applicator according to the invention.

In the liquid applicator 80 shown in FIG. 20, a pair of projections 43 are formed inside of the roller-storing portion 18 by way of engagement with a through-hole 4 of the roller 2.

Figure 21:
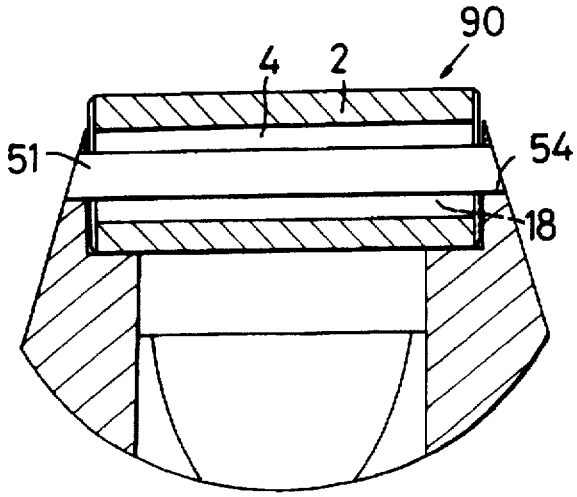
FIG. 21 is an enlarged sectional view of still another form of liquid applicator according to the invention.
Figure 19:
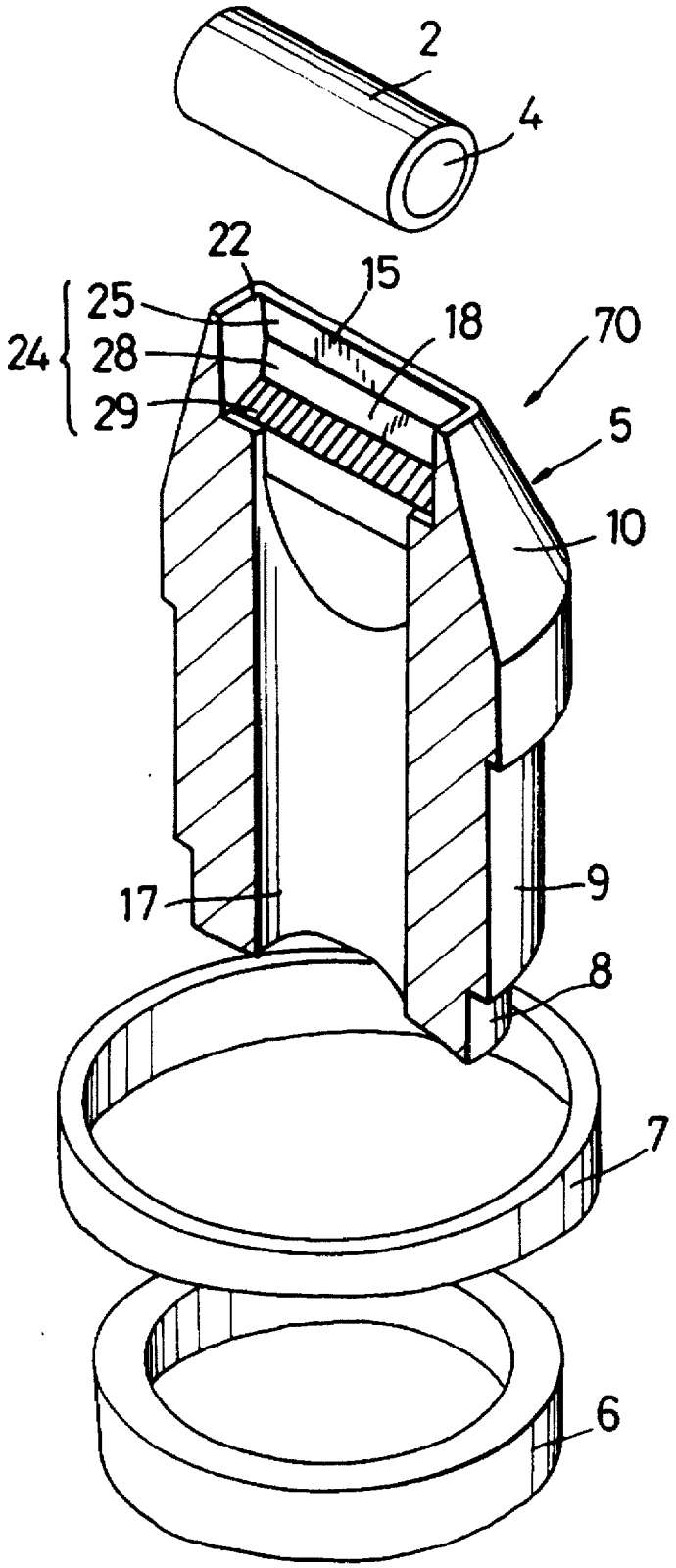
FIG. 19 is a perspective view of disassembled components of the liquid applicator shown in FIG. 14 partially in section.

In the liquid applicator 90 shown in FIG. 21, a shaft 51 is inserted through a through-hole 4 of the roller 2 and is supported in a hole 54 formed in the roller-storing portion 18.

Any of the above-described liquid applicators 70, 80, and 90 disclosed in FIGS. 14 through 21 is resistant to shock without causing the roller 2 to jump out of the roller-storing portion. Since stored ink rarely drops into the ink pool, any of the above liquid applicators, according to the invention, provides satisfactory flow of writing from the initial touch on a paper surface.

We claim:

1. A liquid applicator comprising:

an ink pool having a tip;

a supply of liquid ink in the ink pool;

a holder which is secured to the tip of said ink pool and having a roller-storing portion and an ink passage hole; and a hollow roller having an ink applying surface disposed for rotation in said roller-storing portion of said holder, there being a space between the applying surface of the hollow roller and the roller-storing portion that provides a capillary tube force that prevents ink from flowing through the space to and from the ink pool, there being no shaft extending into the hollow roller to support the hollow roller for rotation in the holder.

2. The liquid applicator according to claim 1, wherein said roller-storing portion has a tip, said roller-storing portion has an aperture at the tip thereof, said roller-storing portion has a bottom surface at said ink passage hole, a relay core is disposed inside of said ink passage hole, said relay core comes into contact with said roller, and said roller is pressed towards said aperture of said roller-storing portion by said relay core.

3. The liquid applicator according to claim 2 wherein said bottom surface of said roller-storing portion is defined by at least two tapered surface portions with each said tapered surface portion having one of a flat and curved shape as viewed in cross section.

4. The liquid applicator according to claim 3, wherein said ink pool has a supply of ink having a maximum of 8000 CPS of viscosity under normal temperature.

5. The liquid applicator according to claim 1 wherein the space between the applying surface of the hollow roller and the roller-storing portion is approximately 0.04 mm.

6. The liquid applicator of according to claim 2, wherein the bottom surface of the said roller-storing portion is defined by first and second tapered surface portions, with each tapered surface portion having a substantially flat shape, said first tapered surface portion defining an acute angle, and said second tapered surface portion defining an obtuse angle, as viewed in cross section.

7. A liquid applicator comprising:

an ink pool having a tip;

a supply of liquid ink in the ink pool;

a holder which is secured to the tip of said ink pool and having a roller-storing portion and an ink passage hole; and a porous roller having an ink applying surface disposed for rotation in said roller-storing portion of said holder, there being a space between the applying surface of the porous roller and the roller-storing portion that provides a capillary tube force that prevents ink from flowing through the space to and from the ink pool, there being no shaft extending into the porous roller to support the porous roller for rotation in the holder.

8. A liquid applicator comprising:

an ink pool having a tip;

a supply of liquid ink in the ink pool;

a holder which is secured to the tip of said ink pool and having a roller-storing portion and an ink passage hole; and a roller having an ink applying surface disposed in said roller-storing portion of said holder, there being a space between the applying surface of the roller and the roller-storing portion that provides a capillary tube force that prevents ink from flowing through the space to and from the ink pool, wherein the roller-storing portion is defined by a tapered surface portion, with the tapered surface portion being substantially flat and defining an obtuse angle as viewed in cross section.

9. The liquid applicator according to claim 8, wherein the roller-storing portion has an aperture, a relay core with a tip is disposed in said ink passage hole, the tip of said relay core comes into contact with said roller, and said roller is pressed toward the aperture in said roller-storing portion by said relay core.

10. The liquid applicator according to claim 9, wherein said ink pool has a supply of ink containing a maximum of 8000 CPS of viscosity under normal temperature.

11. The liquid applicator according to claim 8, wherein said roller has one of a hollow and a porous construction.

12. The liquid applicator according to claim 8 wherein the roller storing position is defined additionally by a second tapered surface portion that is substantially flat and defines an acute angle as viewed in cross section.

13. A liquid applicator comprising:

an ink pool having a tip;

a supply of liquid ink in the ink pool;

a holder which is secured to the tip of said ink pool and having a roller-storing portion with an aperture and an ink passage hole; a roller having an ink applying surface disposed in said roller-storing portion of said holder, there being a space between the applying surface of the roller and the roller-storing portion that provides a capillary tube force that prevents ink from flowing through the space to and from the ink pool; and a relay core disposed in said ink passage hole of said holder, wherein said roller is pressed toward the aperture of said roller-storing portion by said relay core, there being no shaft extending into the roller to support the roller for rotation on the holder.

14. The liquid applicator according to claim 13, wherein said roller has a circumferential surface and with said liquid applicator not applying a liquid, the circumferential surface of said roller substantially seals said aperture of said roller-storing portion.

15. The liquid applicator according to claim 14, wherein said roller-storing portion is defined at least in part by a surface, said roller floats over the surface of said roller-storing portion at said ink passage hole.

16. The liquid applicator according to claim 15, wherein said ink pool contains a supply of aqueous ink.

17. The liquid applicator according to claim 16, wherein the roller-storing portion is defined by a surface having at least two tapered surface portions, with each said tapered surface portion having one of a flat and curved shape as viewed in cross section.

18. A liquid applicator comprising:

an ink pool having a tip;

a supply of liquid ink in the ink pool;

a holder which is secured to the tip of said ink pool and having a roller-storing portion and an ink passage hole; and a roller having an ink applying surface disposed in said roller-storing portion of said holder, there being a space between the applying surface of the roller and the roller-storing portion that provides a capillary tube force that prevents ink from flowing through the space to and from the ink pool, wherein the roller-storing portion is defined by at least three tapered surface portions, with each said tapered surface portion having a substantially flat shape and defining an angle as viewed in cross section.

* * * * *